United States Patent [19]

MacNeill

[11] 4,063,372

[45] Dec. 20, 1977

[54] GOLF SPIKE

[75] Inventor: Arden B. MacNeill, Sudbury, Mass.

[73] Assignee: MacNeill Engineering Company, Waltham, Mass.

[21] Appl. No.: 620,415

[22] Filed: Oct. 7, 1975

[51] Int. Cl.[2] ..... A43B 5/00; A43C 15/00

[52] U.S. Cl. ..... 36/127; 36/67 D

[58] Field of Search ..... 36/67 D, 59 R, 127

[56] References Cited

U.S. PATENT DOCUMENTS

| | | | |
|---|---|---|---|
| 2,178,106 | 10/1939 | Pierce et al. | 36/67 D |
| 2,506,801 | 5/1950 | MacNeill | 36/59 R |
| 2,624,128 | 1/1953 | Phillips | 36/67 D |
| 3,552,043 | 1/1971 | Moffa | 36/67 D |

*Primary Examiner*—Patrick D. Lawson

*Attorney, Agent, or Firm*—Cesari and McKenna

[57] ABSTRACT

A golf spike which locks securely to the sole of a golf shoe when attached thereto has a convex face plate with a spike member extending centrally therethrough and is secured to the plate by first and second spaced apart flanges formed on the spike member. One of the flanges has a ribbed face in contact with the plate to help lock the plate thereto when the flanges are pressed against it. Notches formed at the edge of the plate accomodate part of the sole material therein when the plate is secured against the sole of a golf shoe, and thus firmly lock the spike to the shoe. The trailing edge of the notches is upturned to facilitate attachment of the spike and minimize scoring.

4 Claims, 5 Drawing Figures

GOLF SPIKE

BACKGROUND OF THE INVENTION

A. Field of the Invention

The invention relates to golf spikes, and comprises a two-piece rigid golf spike which is readily locked to the sole of a golf shoe.

B. Prior Art

Golf spikes are a form of cleat which are attached to the shoe of a wearer for engaging turf to thereby provide a firm grip. Typically, the golf spikes consist of a rounded plate, having a spike protruding therefrom for engaging the turf.

Various methods of attaching the spikes to the shoe may be used, but the method most commonly used is to provide a threaded head on the inward-facing end of the spike which screws into a matching threaded receptacle in the sole of the shoe. In order to lock the plate to the shoe and prevent its unscrewing, protuberances are sometimes provided on the concave side of the plate; these protuberances bear against the sole of the shoe with increasing force as the spike is screwed into the shoe, and provide forces resisting unscrewing.

Sometimes these protuberances are in the form of a sawtooth to provide a more effective resisting force; for example, see U.S. Pat. No. 2,624,128, issued Jan. 6, 1973 to Fred C. Phillips and entitled "Calk for Golf Shoes". These protuberances score the sole of the shoe during insertion and form a groove in which the material is compressed and chafed. This damages the shoe, and reduces the number or times that the spikes can be replaced without also replacing or repairing the shoe.

Frequently the spike member and the plate are two spearate members which are joined together during manufacturing to form a single unit. A strong bond between the two is required to resist the hard usage the golf spikes receive during normal wear. Further, the golf spikes are frequently most conveniently attached to golf shoes by utilizing the plate portion as a torque-applying member. This imposes a further substantial strain on the fastening between the plate and the spike member.

Various methods have been used to provide the necessary connecting strength between the parts. Typically, however, the strongest bonds have been produced by requiring substantial metal flow between the spike and the plate. This complicates the required tooling and increases manufacturing costs.

BRIEF DESCRIPTION OF THE INVENTION

A. Objects of the Invention

Accordingly, it is an object of the invention to provide an improved golf spike.

Further, it is an object of the invention to provide a golf spike having an improved means for locking to the sole of a golf shoe.

Another object of the invention is to provide an improved golf spike in which the spike is simply but securely attached to the plate member.

A further object of the invention is to provide an improved method of manufacturing a golf spike.

B. Brief Description of the Invention

In accordance with the present invention, I provide a golf spike of two-piece construction comprising a generally convexly shaped plate having a central aperture therein for receiving an elongated spike member extending through the plate. The convex face of the plate is directed outwardly, away from the sole, while the concave face is directly inwardly, toward the sole.

The outerperiphery of the plate has at least two notches formed therein and spaced around the periphery. Each notch has a leading edge and a trailing edge. The leading edge is that which "leads" in the direction of motion as one threads the golf spike into the sole plate of the shoe; the trailing edge is the other edge of the notch, that is, the "lagging" edge. As the golf spike is screwed into the sole plate, the periphery of the plate presses with increasing force against the sole material. This material flows into the notch and the plate is thereby "locked" to the sole. The trailing edge of the notch is turned slightly outwardly of the convex face; this minimizes scoring of the sole material, and additionally facilitates attachment of the spike to the shoe.

The spike member comprises an elongated spike having a radially extending flange formed thereon approximately one-third the distance from the wear end thereof (the wear end is that end which extends outwardly from the shoe). The under-face of the flange (the face directed away from the wear end) has one or more radially extending ribs formed in its surface. When the spike member is extended through the central aperture of the plate, the flange rests in a corresponding well formed in the plate, the ribs of the flange resting against the well surface.

The spike member is joined to the plate during manufacture by upsetting the sole end (the end of the spike member opposite the wear end) to form a second flange on the spike member on the opposite side of the plate from the first flange. The two flanges together tightly press against the plate and hold it securely therebetween. Further, the ribs on the bottom face of the first plate press into the well portion of the plate. and secure the spike member against rotation with respect to the plate. The joining strength is sufficient to resist the torque caused by insertion of the spike into the sole plate of the golf shoe, as well as to withstand the normal forces encountered during wear. The assembled golf spike is thereafter threaded and is ready for use.

DETAILED DESCRIPTION OF THE INVENTION

The foregoing and other and further objects and features of the invention will be more readily understood from the following detailed description of the invention, when taken in conjunction with the accompanying drawings, in which.

Figure 1:
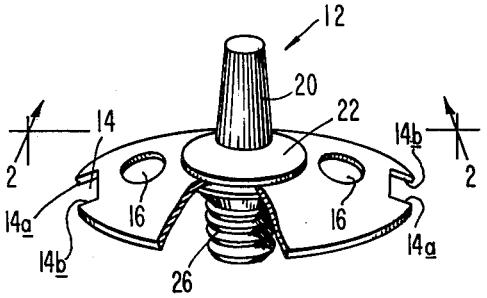
FIG. 1 is a view in perspective of a golf spike constructed in accordance with the invention.

In FIG. 1 a golf spike is formed from a convex plate 10 having secured thereto a spike member 12. The plate 10 has notches 14 extending about its periphery; these notches have leading edges 14*a* and trailing edges 14*b*. As may be seen more clearly from FIGS. 2 and 3, the trailing edges 14*b* of these notches curve outwardly of the plate a slight amount to facilitate attachment of the golf spike and prevent scoring of the sole of the golf shoe; this will be described in more detail below. Apertures 16 extending through the plate 10 provide a means of inserting a two pronged golf spike wrench to apply torque to the spike to attach it to the shoe.

Figure 2:
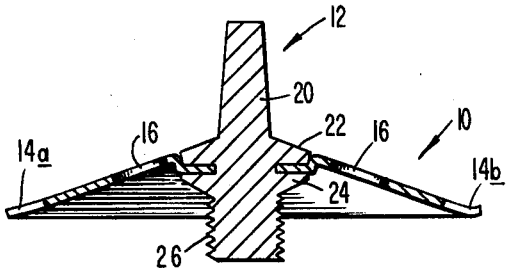
FIG. 2 is a sectional view along the lines 2—2 of FIG. 1.

The spike member 12 comprises a wear portion 20 extending outwardly of the convex face of the plate 10, an upper flange 22, and a lower flange 24, (see FIG. 2). The lower flange is formed during attachment of the spike member to the plate, as will shortly be described. The lower end of the spike member 12 comprises a threaded shank 26 which extends from the concave face of the plate 10 for attachment to the golf shoe. The flanges 22 and 24 grip the plate 10 securely between them.

Figure 3:
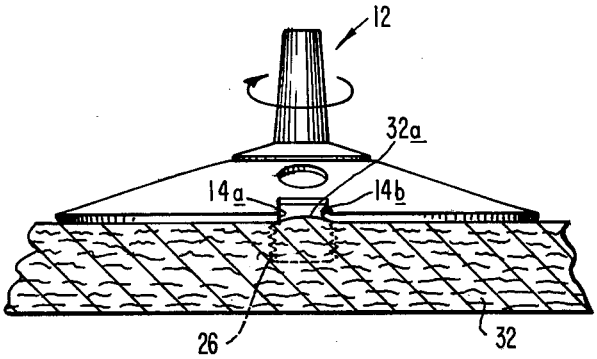
FIG. 3 is a vertical view, partly in section, of a spike attached to the sole of the shoe and showing the locking action of the edge notches.

Turning now to FIG. 3, there is shown a golf spike fully inserted into a spike-receiving receptacle 30 which is embedded in a portion 32 of the sole of a golf shoe. That portion of the sole 32 against which the outer periphery of the plate bears at points other than the notches is compressed by the plate. However, that portion 32*a* of the sole which lies beneath the area formed by the notches is extruded slightly into these notches; this locks the golf spike to the sole of the shoe and prevents its unscrewing. If, now, a torque is exerted on the spike in such a direction as to tend to unseat it (a torque in the direction opposite the arrow in FIG. 3), the leading edge 14*a* of the plate 10 tends to dig into the protruding material 32*a* and causes the golf spike to resist unseating.

In FIG. 3 it will be noted that the trailing edge 14*b* is turned slightly outwardly from the concave (upper face) of the plate 10. This prevents the trailing edge 14 *b* of the notch 14 from cutting into and scoring the sole of the shoe as the spike is screwed into it (in the direction of the arrow in FIG. 3). This conserves the shoe material and additionally facilitates attachment of the golf spike.

Figure 4:
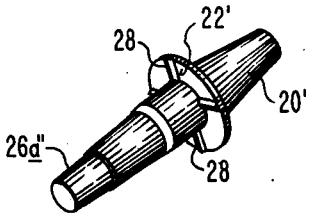
FIG. 4 is a view in perspective of a spike member in accordance with the present invention, and showing the ribbed underside of the upper flange of the spike member.

Turning now to FIG. 4, the spike member is shown in the form it has prior to attachment to the plate 10. The spike 40 has a wear end 20', a sole end 26', consisting of stepped sections 26'*a* and 26'*b*, and a flange 22 containing radially-extending ribs 28.

Figure 5:
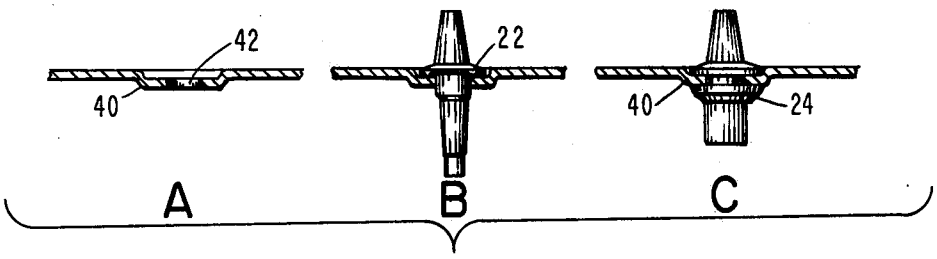
FIG. 5 is a sketch of various stages in the manufacture and assembly of the golf spike of the present invention, illustrating formation of the flange of the spike member and its securing to the base plate.

To form a golf spike in accordance with the present invention, a thin flat sheet of material such as mild steel and of a width somewhat larger than the diameter of the plate is passed through a punch press. Referring to FIG. 5, the press forms a well 30 in the sheet material of a size sufficient to accomodate the flange 22 of the spike member 20. The well has a central aperature 42 to accomodate the sole end of the spike member as shown in FIG. 5B, the ribs 28 of the flange resting against the upper face of the well. As shown in FIG. 5C, the sole end of the spike member is then upset with the aid of a punch die to thereby form the lower flange 24. Simultaneously, this firmly embeds the ribs 28 into the face 40 to thereby secure the spike member in the plate. Thereafter, the plate is formed with the notches 14 and apertures 16, and is thereafter detached from the blank sheet material. A threaded surface is then formed on the sole end of the spike member 12 and the golf spike is ready for use.

From the foregoing it will be seen that I have provided a substantially improved golf spike, together with an improved and economical method of constructing it. The spike is of two piece construction which facilitates its manufacture, yet the spike member is securely attached to the plate and resists turning even though substantial torque is applied to it through the plate. The shaped notches in the outer edge of the plate facilitate attachment of the spike and lock it securely without unduly scoring the sole material of the golf shoe. Thus, spikes of this kind can be replaced on golf shoes numerous times without extensively damaging the shoe.

It will be understood that various changes may be made in the foregoing illustrative description of the invention without departing from either the spirit or the scope thereof, and it is intended that such changes be encompassed herein, the scope of the invention being defined with particularity in the claims. It will be understood that although the invention has been described with specific reference to a golf spike, it is of broad applicability to any type of cleated shoe, although it is particularly useful in connection with golf shoes.

Having illustrated and described my invention, I claim:

1. A locking golf spike, comprising:
   A. a plate defined by first and second opposed faces and
      1. having, at the outer periphery thereof, a plurality of notches from which the plate material is entirely removed to thereby accomodate inflow of shoe sole material for locking the plate to said sole when the plate and sole are tightly pressed together,
      2. defining a central aperture for receiving a spike member therethrough, and
   B. an elongated spike member
      1. having a threaded portion thereof extending inwardly of said plate through said aperture for securing to a shoe with the periphery of said plate pressing into the sole of said shoe,
      2. having a flange formed thereon intermediate the ends thereof and a plurality of ribs on a face thereof directed toward said plate when assembled therewith,
   C. said plate has a centrally-formed well surrounding said aperature on a first face thereof for receiving said flange therein with said ribs contacting the surface of said well to secure said spike member thereto.

2. A golf spike according to claim 1 including a second flange formed on said spike member and in contact with said second face of said plate securing said plate in cooperation with said first flange.

3. A locking golf spike, comprising:
   A. a plate defined by first and second opposed faces and having a central aperture for receiving a spike member therethrough and a well surrounding said aperture on a first face thereof;
   B. an elongated spike member extending through said aperture and secured at an intermediate portion thereof to said plate, said spike member having
      1. a threaded portion thereof extending inwardly of said plate for securing to a shoe with the periphery of said plate pressing into the sole of said shoe, and
      2. a flange formed thereon intermediate the ends thereof and having a plurality of ribs on a face thereof imbedded within the face of said well when assembled with said plate to thereby secure said spike member thereto.

4. A golf spike according to claim 3 including a second flange formed on said spike member and in contact with said second face of said plate and securing said plate to said spike in cooperation with said first flange.

* * * * *